US011450272B2

(12) United States Patent
Oh

(10) Patent No.: US 11,450,272 B2
(45) Date of Patent: Sep. 20, 2022

(54) ORGANIC LIGHT EMITTING DIODE DISPLAY DEVICE AND METHOD OF DRIVING THE SAME

(71) Applicant: LG Display Co., Ltd., Seoul (KR)

(72) Inventor: Yun-Mi Oh, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/121,436

(22) Filed: Dec. 14, 2020

(65) Prior Publication Data

US 2021/0201783 A1 Jul. 1, 2021

(30) Foreign Application Priority Data

Dec. 31, 2019 (KR) ..... 10-2019-0178883

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2310/0286* (2013.01); *G09G 2310/0291* (2013.01); *G09G 2320/064* (2013.01)

(58) Field of Classification Search
CPC ..... G09G 3/32–3291; G09G 2300/08; G09G 2300/0809; G09G 2300/0819; G09G 2310/0243; G09G 2310/0248; G09G 2310/0251; G09G 2310/0262; G09G 2310/0286; G09G 2310/0291; G09G 2310/06; G09G 2310/08; G09G 2320/0233; G09G 2320/0238; G09G 2320/0257; G09G 2320/0626; G09G 2320/064
See application file for complete search history.

(56) References Cited

U.S. PATENT DOCUMENTS

| | | | | |
|---|---|---|---|---|
| 9,984,747 | B2 | 5/2018 | Ham | |
| 2016/0351121 | A1* | 12/2016 | Kim | G09G 3/3233 |
| 2017/0061878 | A1* | 3/2017 | Park | G09G 3/3233 |
| 2017/0270869 | A1* | 9/2017 | Ma | G09G 3/3266 |
| 2018/0108407 | A1 | 4/2018 | Ham | |
| 2019/0051252 | A1* | 2/2019 | Shi | G09G 3/3225 |
| 2020/0168156 | A1* | 5/2020 | Yin | G09G 3/3258 |
| 2020/0184877 | A1* | 6/2020 | Pyun | G09G 3/3688 |

FOREIGN PATENT DOCUMENTS

KR 10-2018-0042645 A 4/2018

* cited by examiner

*Primary Examiner* — Nathan Danielsen
(74) *Attorney, Agent, or Firm* — Fenwick & West LLP

(57) ABSTRACT

An organic light emitting diode display device includes: a display panel including a plurality of pixel regions; and a reference voltage compensating part, wherein the reference voltage compensating part: supplies a first reference voltage to the plurality of pixel regions during an active section where a data enable signal is activated, and supplies a second reference voltage higher than the first reference voltage to the plurality of pixel regions during a blank section where the data enable signal is deactivated.

9 Claims, 9 Drawing Sheets

ORGANIC LIGHT EMITTING DIODE DISPLAY DEVICE AND METHOD OF DRIVING THE SAME

CROSS REFERENCE TO RELATED APPLICATIONS

The present application claims the priority benefit of Korean Patent Application No. 10-2019-0178883 filed in the Republic of Korea on Dec. 31, 2019, which is hereby incorporated by reference in its entirety for all purposes as if fully set forth herein.

BACKGROUND

Technical Field

The present disclosure relates to an organic light emitting diode display device, and more particularly, to an organic light emitting diode display and a method of driving the organic light emitting diode display device where deviation in luminance by position of an image is minimized during a blank section.

Discussion of the Related Art

Among flat panel display (FPD) devices, an organic light emitting diode (OLED) display device, which has been the subject of recent research, displays an image using a light emitting diode. The light emitting diode may have a thin with a thickness less than about 2000 Å. The OLED display device has a low driving voltage and an excellent color purity.

The light emitting diode includes a hole injecting electrode (an anode), an electron injecting electrode (a cathode) and a light emitting layer between the hole injecting electrode and the electron injecting electrode. The light emitting layer may include a hole injecting layer, a hole transporting layer, an emitting material layer, an electron transporting layer and an electron injecting layer sequentially on the hole injecting electrode.

A hole injected from the anode and an electron injected from the cathode are combined with each other to generate an exciton, and the exciton transitions from an excited state to a ground state to emit a light.

The luminance of the OLED display device may be adjusted through a pulse width modulation (PWM) method where a current flowing through the light emitting diode is controlled with a pulse.

An on state where a current flows through the light emitting diode and an off state where a current does not flow through the light emitting diode are repeated according to a duty period. A duty ratio is defined as a time interval of the on state divided by the duty period.

One frame may include an active section where a data signal is inputted to a pixel region and a blank section where the data signal is not inputted to the pixel region. However, when the active section is switched to the blank section, a reference voltage applied to the pixel region varies. As a result, a phenomenon where a portion of horizontal lines of an image has a different luminance may occur.

Since the phenomenon causes deterioration of a display quality, a uniform luminance by position of an image is required during the blank section.

SUMMARY

Accordingly, embodiments of the present disclosure is directed to an organic light emitting diode display device and a method of driving the organic light emitting diode display device that substantially obviates one or more of the problems due to limitations and disadvantages of the related art.

An object of the present disclosure is to provide an organic light emitting diode display device and a method of driving the organic light emitting diode display device where deviation in luminance by position of an image is minimized during a blank section of a frame.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other advantages and in accordance with the purpose of the present disclosure, as embodied and broadly described herein, an organic light emitting diode display device includes: a display panel including a plurality of pixel regions; and a reference voltage compensating part, wherein the reference voltage compensating part supplies a first reference voltage to the plurality of pixel regions during an active section where a data enable signal is activated, and supplies a second reference voltage higher than the first reference voltage to the plurality of pixel regions during a blank section where the data enable signal is deactivated.

In another aspect, an organic light emitting diode display device includes: a display panel including a plurality of pixel regions; and a reference voltage compensating part, wherein the reference voltage compensating part includes a trigger input terminal and a first switching element, wherein when a first voltage turning off the first switching element is inputted to the trigger input terminal, the reference voltage compensating part outputs a first reference voltage, and wherein when a second voltage turning on the first switching element is inputted to the trigger input terminal, the reference voltage compensating part outputs a second reference voltage higher than the first reference voltage.

In another aspect, a method of driving an organic light emitting diode display device including a display panel including a plurality of pixel regions and a reference voltage compensating part includes: supplying a first reference voltage from the reference voltage compensating part to the plurality of pixel regions during an active section where a data enable signal is activated, and supplying a second reference voltage higher than the first reference voltage from the reference voltage compensating part to the plurality of pixel regions during a blank section where the data enable signal is deactivated.

It is to be understood that both the foregoing general description and the following detailed description are explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Figure 1:
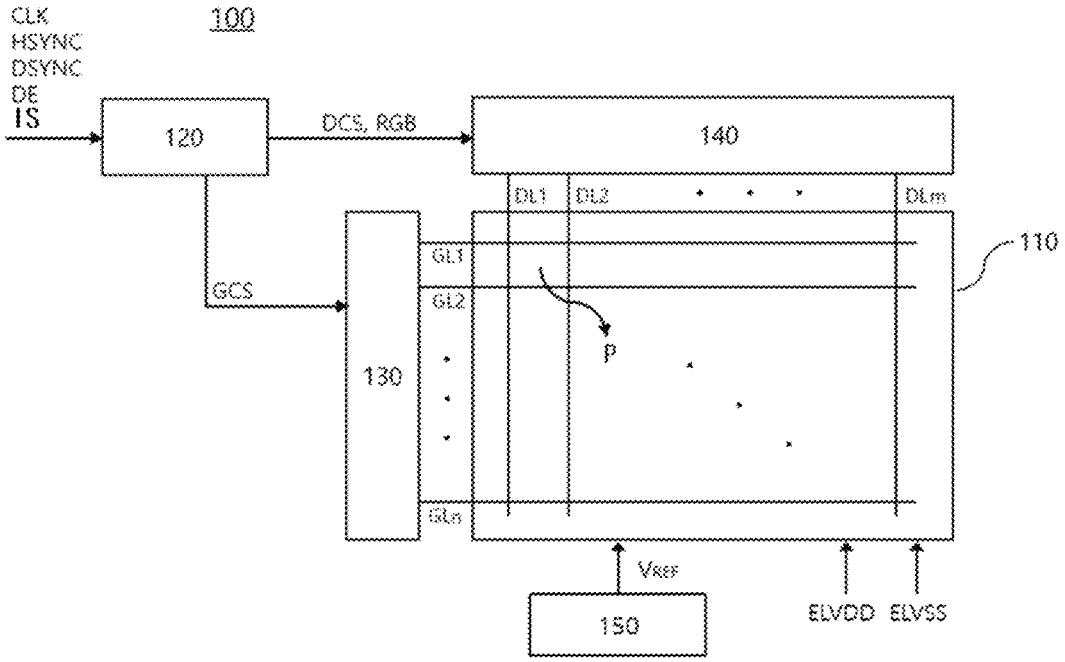
FIG. 1 is a view showing an organic light emitting diode display device according to an embodiment of the present disclosure.

Reference will now be made in detail to aspects of the disclosure, examples of which are illustrated in the accompanying drawings.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range.

In describing a position relationship, when a position relation between two parts is described as, for example, "on," "over," "under," or "next," one or more other parts may be disposed between the two parts unless a more limiting term, such as "just" or "direct(ly)," is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

Hereinafter, an organic light emitting diode display device and a method of driving an organic light emitting diode display device according to embodiments of the present disclosure will be described in detail with reference to the accompanying drawings. In the following description, like reference numerals designate like elements throughout. When a detailed description of well-known functions or configurations related to this document is determined to unnecessarily cloud a gist of the inventive concept, the detailed description thereof will be omitted or will be made brief.

FIG. 1 is a view showing an organic light emitting diode display device according to an embodiment of the present disclosure.

In FIG. 1, an organic light emitting diode (OLED) display device 100 according to an embodiment of the present disclosure includes a display panel 110, a timing controlling part 120, a gate driving part 130, a data driving part 140 and a reference voltage compensating part 150.

The display panel 110 includes a plurality of pixel regions P arranged in a matrix. The plurality of pixel regions P may display red, green and blue colors. The plurality of pixel regions P may further display a white color.

Each of the plurality of pixel regions P may include a light emitting diode, transistors for switching and driving and a storage capacitor.

A plurality of gate lines GL1 to GLn and a plurality of data lines DL1 to DLm are disposed on the display panel 110. The plurality of gate lines GL1 to GLn and the plurality of data lines DL1 to DLm cross each other to define the plurality of pixel regions P. The plurality of gate lines GL1 to GLn may extend to be connected to the gate driving part 130 and may include first and second scan lines and an emission line. The plurality of data lines DL1 to DLm may extend to be connected to the data driving part 140.

The display panel 110 may be connected to a first driving voltage input terminal ELVDD of a high level voltage and a second driving voltage input terminal ELVSS of a low level voltage to supply first and second driving voltages to the plurality of pixel regions P. A current may flow through a driving transistor by the first driving voltage, and a current may be supplied to the light emitting diode.

The display panel 110 may be connected to the reference voltage compensating part 150 to supply a reference voltage VREF to the plurality of pixel regions P. A threshold voltage variation may be compensated by the reference voltage VREF.

The timing controlling part 120 may receive an image signal IS and a plurality of timing signals from a host system. The plurality of timing signals may include a horizontal synchronization signal HSYNC, a vertical synchronization signal VSYNC, a data enable signal DE and a clock signal CLK.

The clock signal CLK is used as a reference signal for synchronizing the timing controlling part 120, the gate driving part 130 and the data driving part 140. The horizontal synchronization signal HSYNC is used as a reference signal for displaying one horizontal line in a frame, and the vertical synchronization signal VSYNC is used as a reference signal for displaying one frame. The data enable signal DE is used as a reference signal for applying a data signal to the plurality of pixel regions P and for classifying an active section and a blank section.

The timing controlling part 120 may generate a gate control signal GCS controlling operation of the gate driving part 130, a data control signal DCS controlling operation of the data driving part 140 and an image data RGB by using the horizontal synchronization signal HSYNC, the vertical synchronization signal VSYNC and the data enable signal DE. The timing controlling part 120 may transmit the gate control signal GCS to the gate driving part 130 and may transmit the data control signal DCS and the image data RGB to the data driving part 140.

The gate driving part 130 may generate a plurality of gate driving signals using the gate control signal GCS. The plurality of gate driving signals may include first and second scan signals and an emission signal for controlling an initialization period, a sampling period and an emission period.

The gate driving part 130 may include a shift register (not shown) having a plurality of stages subordinately connected to each other. The plurality of stages may be connected to the plurality of pixel regions P at horizontal lines of the display panel 110. The plurality of stages may sequentially output the plurality of gate driving signals and may supply the plurality of gate driving signals to the plurality of pixel regions P of the display panel 110 according to an order of the horizontal lines.

The data driving part 140 may generate a data signal of an analog type using the data control signal DCS and the image data of a digital type. The data driving part 140 may correct a magnitude of the data signal using a gamma reference voltage. The data driving part 140 may transmit the data signal to the plurality of pixel regions P of the display panel 110 according to an order of the vertical lines through the plurality of data lines DL1 to DLm.

The reference voltage compensating part 150 may supply the reference voltage VREF to the plurality of pixel regions P of the display panel 110. Specifically, the reference voltage compensating part 150 may supply the increased reference voltage VREF during the blank section. The detailed structure of the reference voltage compensating part 150 will be illustrated later.

Figure 2:
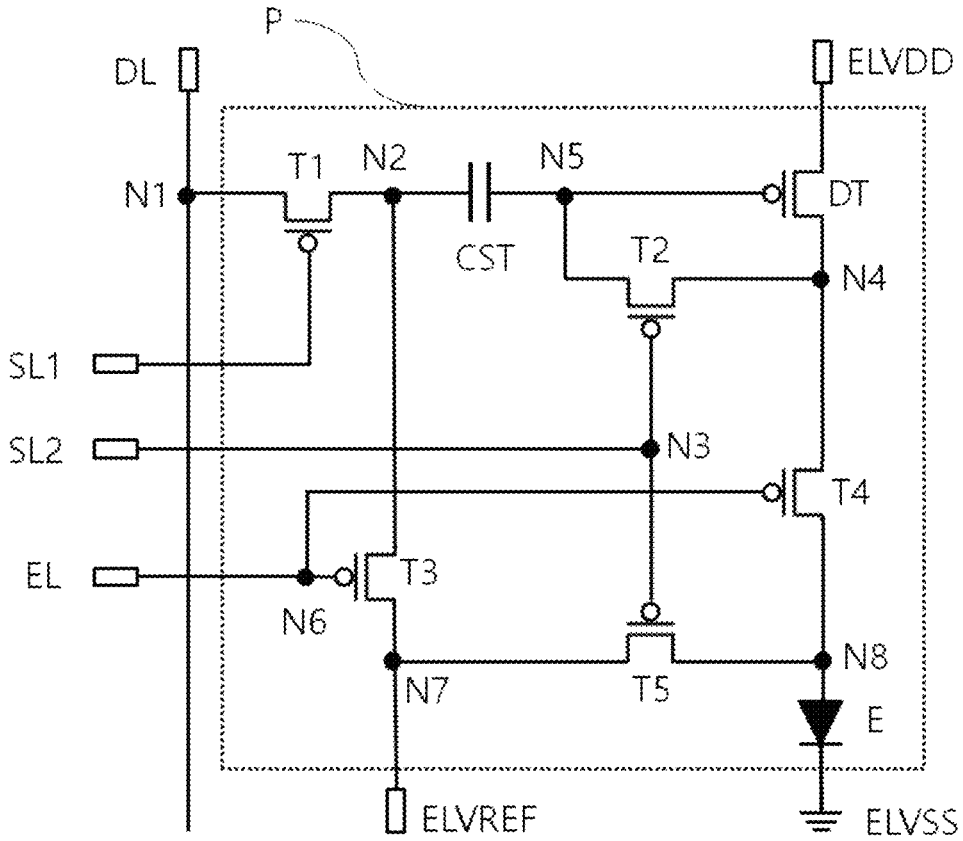
FIG. 2 is a circuit diagram showing a pixel region of an organic light emitting diode display device according to an embodiment of the present disclosure.

FIG. 2 is a circuit diagram showing a pixel region of an organic light emitting diode display device according to an embodiment of the present disclosure.

In FIG. 2, the pixel region P may include first to fifth transistors T1 to T5, a driving transistor DT, a storage capacitor CST and a light emitting diode E.

Although the first to fifth transistors T1 to T5 and the driving transistor DT have a positive (P) type in FIG. 2, the first to fifth transistors T1 to T5 and the driving transistor DT may have a negative (N) type in another embodiment. Alternatively, the first to fifth transistors T1 to T5 and the driving transistor DT may have an N type or a P type independently.

A gate electrode of the first transistor T1 may be connected to the first scan line SL1, a source electrode of the first transistor T1 may be connected to a first node N1, and a drain electrode of the first transistor T1 may be connected to a second node N2.

A gate electrode of the second transistor T2 may be connected to a third node N3, a source electrode of the second transistor T2 may be connected to a fourth node N4, and a drain electrode of the second transistor T2 may be connected to a fifth node N5.

A gate electrode of the third transistor T3 may be connected to a sixth node N6, a source electrode of the third transistor T3 may be connected to the second node N2, and a drain electrode of the third transistor T3 may be connected to a seventh node N7.

A gate electrode of the fourth transistor T4 may be connected to the sixth node N6, a source electrode of the fourth transistor T4 may be connected to the fourth node N4, and a drain electrode of the fourth transistor T4 may be connected to an eighth node N8.

A gate electrode of the fifth transistor T5 may be connected to the third node N3, a source electrode of the fifth transistor T5 may be connected to the eighth node N8, and a drain electrode of the fifth transistor T5 may be connected to the seventh node N7.

A gate electrode of the driving transistor DT may be connected to the fifth node N5, a source electrode of the driving transistor DT may be connected to the first driving voltage input terminal ELVDD, and a drain electrode of the driving transistor DT may be connected to the fourth node N4.

The storage capacitor CST may be connected between the second node N2 and the fifth node N5.

An anode of the light emitting diode E may be connected to the eighth node N8, and a cathode of the light emitting diode E may be connected to the second driving voltage input terminal ELVSS.

The data line DL may be connected to the first node N1, the second scan line SL2 may be connected to the third node N3, and the emission line EL may be connected to the sixth node N6. A reference voltage input terminal ELVREF may be connected to the seventh node N7.

Figure 3A:
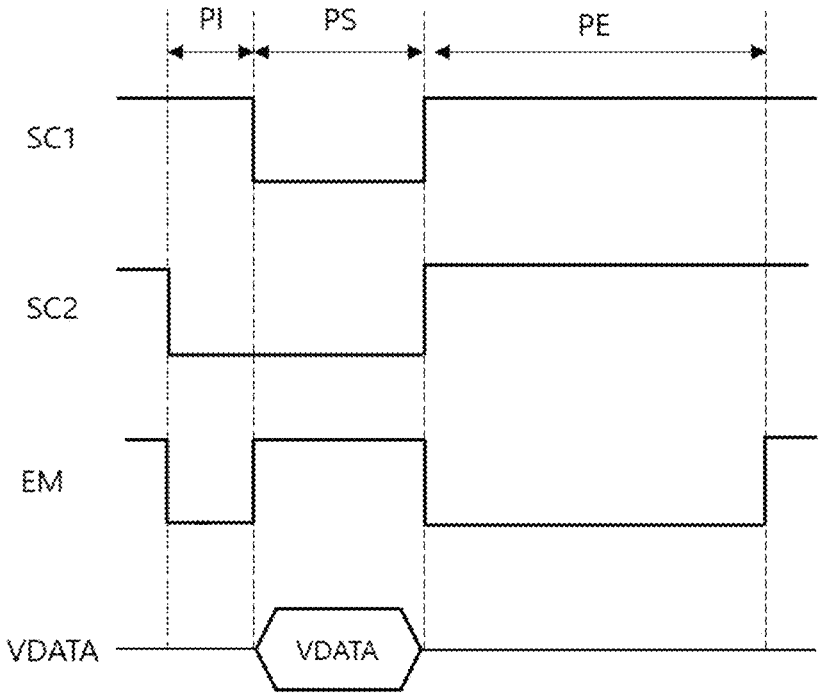
FIG. 3A is a timing diagram showing signals of an organic light emitting diode display device according to an embodiment of the present disclosure.
Figure 3B:
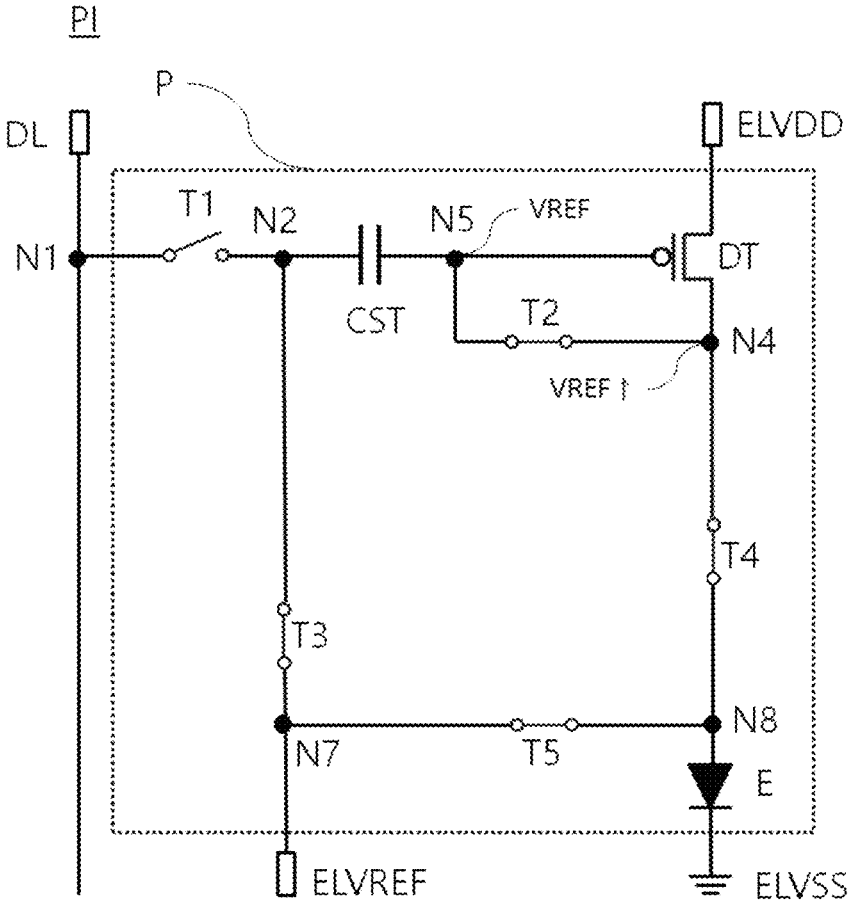
FIG. 3B is an equivalent circuit diagram showing a pixel region of an initialization period of an organic light emitting diode display device according to an embodiment of the present disclosure.
Figure 3C:
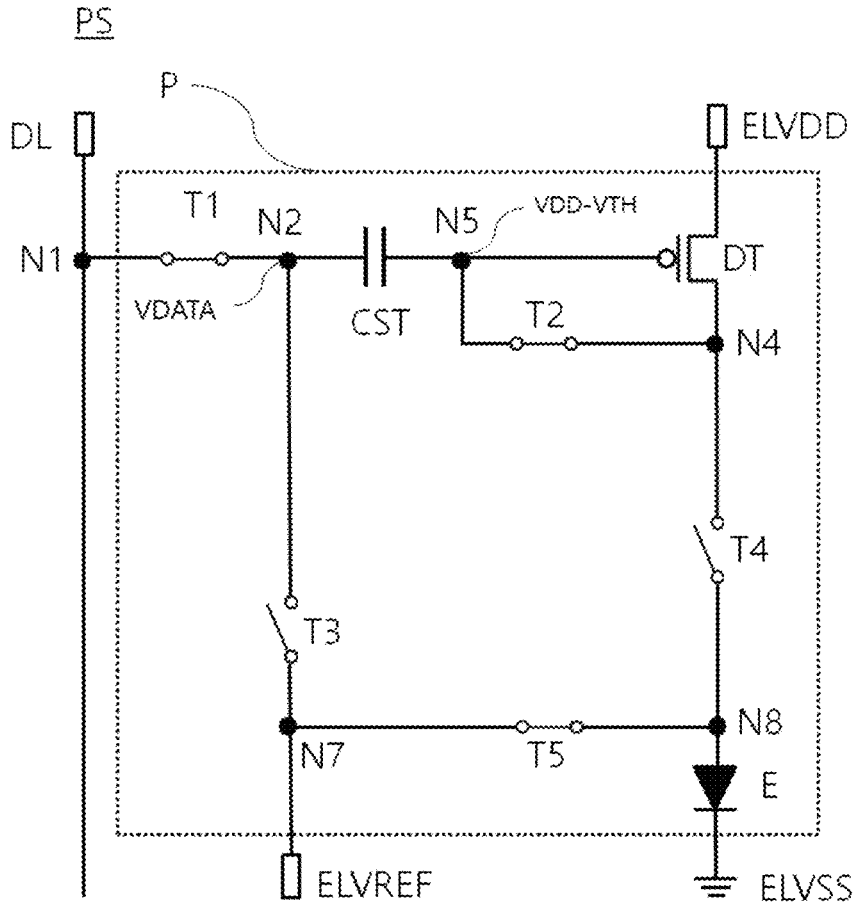
FIG. 3C is an equivalent circuit diagram showing a pixel region of a sampling period of an organic light emitting diode display device according to an embodiment of the present disclosure.
Figure 3D:
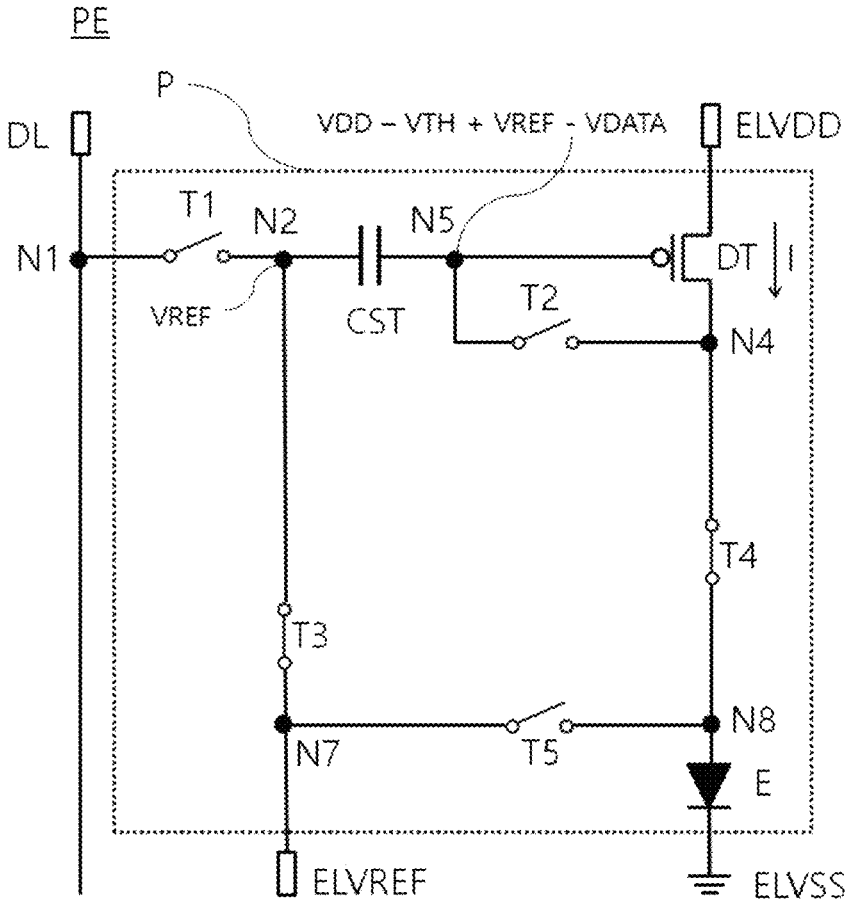
FIG. 3D is an equivalent circuit diagram showing a pixel region of an emission period of an organic light emitting diode display device according to an embodiment of the present disclosure.

FIG. 3A is a timing diagram showing signals of an organic light emitting diode display device according to an embodiment of the present disclosure, and FIGS. 3B, 3C and 3D are equivalent circuit diagrams showing a pixel region of an initialization period, a sampling period and an emission period, respectively, of an organic light emitting diode display device according to an embodiment of the present disclosure.

In FIG. 3A, one frame for driving a pixel region P may be classified into the initialization period PI, the sampling period PS and the emission period PE.

During the initialization period PI of FIG. 3A, the gate driving part 130 (of FIG. 1) applies the first scan signal SC1 of a high level voltage turning off the first transistor T1 to the first scan line SL1. The gate driving part 130 applies the second scan signal SC2 of a low level voltage turning on the second and fifth transistors T2 and T5 to the second scan line SC2 and applies the emission signal EM of a low level voltage turning on the third and fourth transistors T3 and T4 to the emission line EL.

In FIG. 3B corresponding to the initialization period, the first transistor T1 is turned off, and the second to fifth transistors T2 to T5 are turned on.

The second, fourth, fifth, seventh and eighth nodes N2, N4, N5, N7 and N8 are connected to the reference voltage input terminal ELVREF to be initialized by the reference voltage VREF.

Since the fifth node N5 is initialized by the reference voltage VREF, the driving transistor DT may be turned on. Since the first driving voltage VDD and the reference voltage VREF are applied to the fourth node N4, an electric shortage may occur. As a result, the reference voltage VREF applied to the pixel region P may increase.

During the sampling period PS of FIG. 3A, the gate driving part 130 applies the first scan signal SC1 of a low level voltage turning on the first transistor T1 to the first scan line SL1. The gate driving part 130 applies the second scan signal SC2 of a low level voltage turning on the second and fifth transistors T2 and T5 to the second scan line SC2 and applies the emission signal EM of a high level voltage turning off the third and fourth transistors T3 and T4 to the emission line EL.

The data driving part 140 (of FIG. 1) applies the data signal (data voltage) VDATA to the data line DL to supply the data signal VDATA to the first node N1 of the pixel region P.

In FIG. 3C corresponding to the sampling period, the first, second and fifth transistors T1, T2 and T5 are turned on, and the third and fourth transistors T3 and T4 are turned off.

The data signal VDATA of the data line DL is applied to the second node N2. Since the first driving voltage VDD is applied to the driving transistor DT, a voltage difference (VDD−VTH) of a threshold voltage VTH subtracted from the first driving voltage VDD is applied to the fifth node N5.

During the emission period PE of FIG. 3A, the gate driving part 130 applies the first scan signal SC1 of a high level voltage turning off the first transistor T1 to the first scan line SL1. The gate driving part 130 applies the second scan signal SC2 of a high level voltage turning off the second and fifth transistors T2 and T5 to the second scan line SC2 and applies the emission signal EM of a low level voltage turning on the third and fourth transistors T3 and T4 to the emission line EL.

In FIG. 3D corresponding to the emission period, the first, second and fifth transistors T1, T2 and T5 are turned off, and the third and fourth transistors T3 and T4 are turned on.

As a result, the data signal VDATA of the second node N2 is changed to the reference voltage VREF, and a voltage difference (VREF−VDATA) of the data signal VDATA subtracted from the reference voltage VREF is charged in the storage capacitor CST.

In addition, the voltage difference (VREF−VDATA) of the data signal VDATA subtracted from the reference voltage VREF is additionally applied to the fifth node N5 having the voltage difference (VDD−VTH) of the threshold voltage VTH subtracted from the first driving voltage VDD by the storage capacitor CST. Accordingly, a voltage of the fifth node N5 becomes "VDD−VTH+VREF−VDATA."

A driving current I is generated in the driving transistor DT by a voltage difference (gate-source voltage Vgs) between the gate electrode and the source electrode of the driving transistor DT. The driving current I may be supplied to the light emitting diode E through the fourth transistor T4 such that the light emitting diode E emits a light.

Since the gate-source voltage Vgs of the driving transistor DT is "VDATA−VREF+VTH," the driving current I may be expressed by the following equation 1.

$$I = (k/2)*(Vgs - VTH)^2 = (k/2)*(VDATA - VREF + VTH - VTH)^2 = (k/2)*(VDATA - VREF)^2 \quad k = \mu * C * (W/L) \qquad \text{[EQUATION 1]}$$

In equation 1, μ is an electron mobility, C is a capacitance due to the gate insulating layer of the driving transistor DT, W is a channel width of the driving transistor DT, and L is a channel length of the driving transistor DT.

Since the first driving voltage VDD and the reference voltage VREF are applied to the fourth node N4 through the initialization period PI, an electric shortage may occur and the reference voltage VREF applied to the pixel region P may increase. Since the reference voltage VREF increases according to the equation 1, the driving current I may decrease. As a result, the amount of light emitted from the light emitting diode E may decrease and the luminance of the OLED display device may be reduced.

Figure 4:
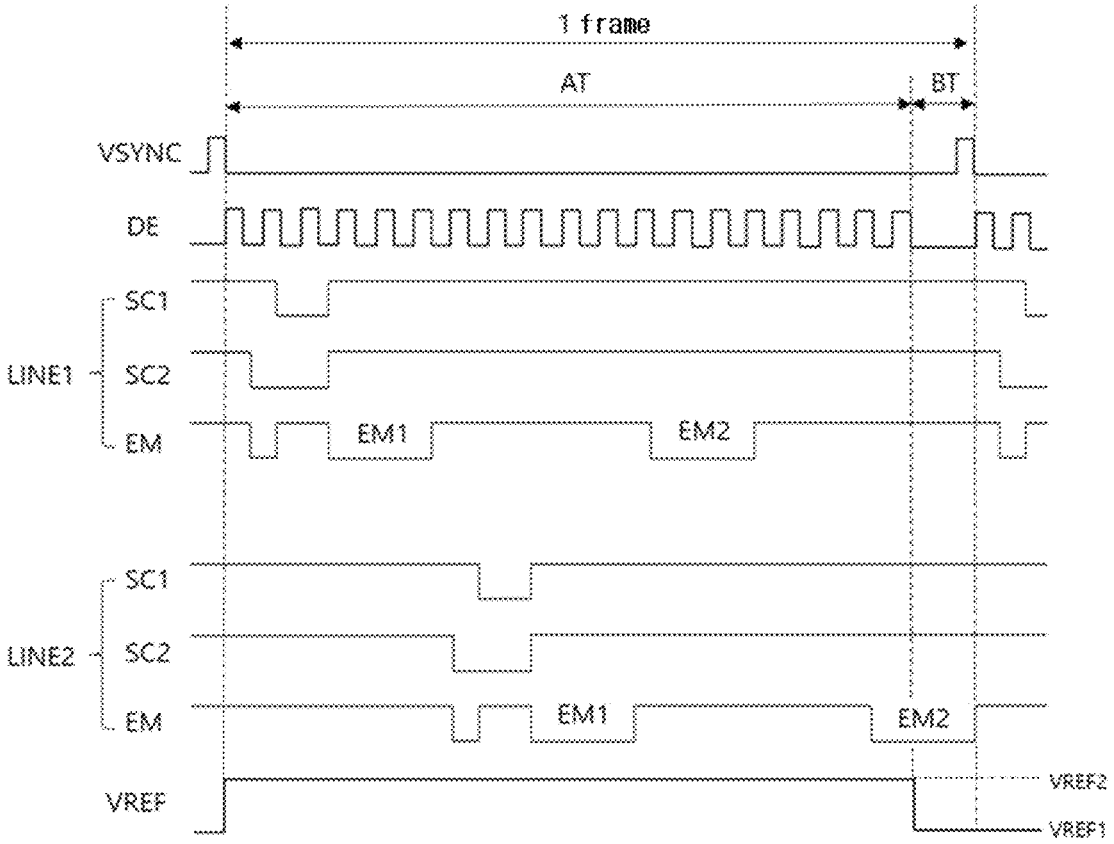
FIG. 4 is a timing chart showing driving signals for a duty driving method of an organic light emitting diode display device according to an embodiment of the present disclosure.

FIG. 4 is a timing diagram showing driving signals for a duty driving method of an organic light emitting diode display device according to an embodiment of the present disclosure.

In FIG. 4, a single frame may be defined by an input period of the vertical synchronization signal VSYNC. The single frame may be classified into the active section AT where the data enable signal DE is activated and the data signal VDATA (of FIG. 3A) is supplied to the pixel region P (of FIG. 1) and the blank section BT where the data enable signal DE is deactivated and the data signal VDATA is not supplied to the pixel region P.

The first and second scan signals SC1 and SC2 and the emission signal EM may be sequentially supplied to the pixel region P by a horizontal line. A first horizontal line LINE1 is disposed prior to a second horizontal line LINE2 and may receive the first and second scan signals SC1 and SC2 and the emission signal EM earlier than the second horizontal line LINE2.

When current continuously flows through the driving transistor DT and the light emitting diode E is continuously turned on, the lifetimes of the driving transistor DT and the light emitting diode E may be reduced. To prevent reduction of the lifetimes, the OLED display device 100 may be driven by a duty driving method where the emission signal EM is divided in one frame.

In the duty driving method, a stage of a shift register of the gate driving part 130 may alternately and repeatedly supply the emission signals EM of a low level voltage and a high level voltage to the pixel region P in K times.

In FIG. 4, the emission signal EM1 and EM2 of a low level voltage turning on the third and fourth transistors T3 and T4 (of FIG. 2) connected to the emission line EL (of FIG. 2) is exemplarily supplied to the pixel region P in two times during one frame. However, the number of times of supplying the emission signal of a low level voltage during one frame is not limited thereto. For example, the emission signal EM of a low level voltage may be supplied to the pixel region P two times to four times during one frame.

During the active section AT, since the initialization period PI is performed for applying the data signal VDATA, the reference voltage VREF applied to the pixel region P may increase. For example, the reference voltage VREF applied to the pixel region P may increase from a first reference voltage VREF1 to a second reference voltage VREF2 during the active section AT. As a result, the driving current I and a luminance of the light emitting diode E (of FIG. 2) may be reduced.

However, during the blank section BT, since the data signal VDATA is not applied to the pixel region P, the initialization period PI is not performed and the reference voltage VREF applied to the pixel region P does not increase. For example, the reference voltage VREF applied to the pixel region P may be maintained as the first reference voltage VREF1 during the blank section BT.

When the emission signal EM2 of a low level voltage according to the duty driving method is supplied to one horizontal line of the display panel 110 during the blank section BT, the reference voltage VREF does not increase from the first reference voltage VREF1 to the second reference voltage VREF2 and the driving current I is not reduced. As a result, the corresponding horizontal line has a higher luminance than the other horizontal line.

In FIG. 4, the emission signal EM2 of a low level voltage is supplied to the second horizontal line LINE2 during the blank section BT. During the blank section BT where the data enable signal DE is not inputted, although the data signal VDATA is not supplied to the display panel 110, the emission signal EM2 of a low level voltage is continuously supplied to the display panel 110. If the emission signal EM2 of a low level voltage is not supplied to the display panel 110 during the blank section BT, an interval between the emission signals EM2 of a low level voltage of the present frame and the next frame increases and an interval between the currents supplied to the light emitting diode E is reduced so that an amount of light emitted from the light emitting diode E can be reduced.

During the blank section BT, since the reference voltage VREF does not increase from the first reference voltage VREF1 to the second reference voltage VREF2, the luminance of the second horizontal line LINE2 is higher than the luminance of the first horizontal line LINE1. As a result, the image displayed by the OLED display device 100 may have a horizontal white line.

Since the reference voltage VREF increases due to the reference voltage compensating part 150 (of FIG. 1) during the blank section BT, the OLED display device 100 has uniform luminance. The reference voltage compensating part 150 will be illustrated hereinafter.

Figure 5:
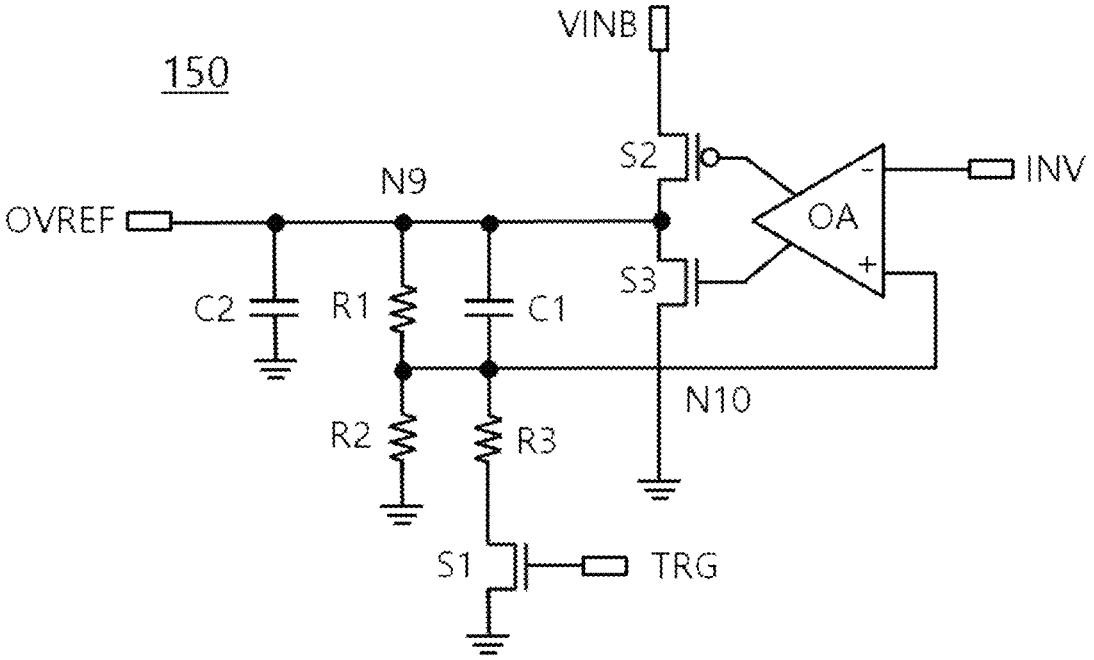
FIG. 5 is a circuit diagram showing a reference voltage compensating part of an organic light emitting diode display device according to a first embodiment of the present disclosure.

FIG. 5 is a circuit diagram showing a reference voltage compensating part of an organic light emitting diode display device according to a first embodiment of the present disclosure.

In FIG. 5, the reference voltage compensating part 150 may include an operational amplifier (OP AMP) OA, first to third resistors R1 to R3, first and second capacitors C1 and C2, first to third switching elements S1 to S3, a trigger input terminal TRG, a high level voltage input terminal VINE, an inversion voltage input terminal INV and a reference voltage output terminal OVREF.

The first resistor R1 and the first capacitor C1 may be connected between ninth and tenth nodes N9 and N10. The second resistor R2 may be connected between the tenth node N10 and a ground terminal, and the second capacitor C2 may be connected between the ninth node N9 and the ground terminal.

The third resistor R3 may be connected to the tenth node N10 and a drain electrode of the first switching element S1. A gate electrode of the first switching element S1 may be connected to the trigger input terminal TRG, and a source electrode of the first switching element S1 may be connected to the ground terminal.

A non-inversion input terminal (+) of the operational amplifier OA may be connected to the tenth node N10, and an inversion input terminal (−) of the operational amplifier OA may be connected to the inversion voltage input terminal INV. Two output terminals of the operational amplifier OA may be connected to gate electrodes, respectively, of the second and third switching elements S2 and S3. For example, a voltage of about 0.8V may be connected to the inversion voltage input terminal INV.

A source electrode of the second switching element S2 may be connected to the high level voltage input terminal VINE, and a drain electrode of the second switching element S2 may be connected to the ninth node N9. A source electrode of the third switching element S3 may be connected to the ground terminal, and a drain electrode of the third switching element S3 may be connected to the ninth node N9.

The reference voltage output terminal OVREF may be connected to the ninth node N9.

The reference voltage VREF of the ninth node N9 which is an output voltage of the reference voltage compensating part 150 and a feedback voltage VFB of the tenth node N10 may be expressed by a following equation 2.

$$VREF=VFB*((R1+RA)/RA)$$

$$RA=(R2*R3)/(R2+R3) \text{ or } R2 \qquad \text{[EQUATION 2]}$$

When a signal turning on the first switching element S1 is inputted to the trigger input terminal TRG, a total resistance RA of the second and third resistors R2 and R3 connected in parallel becomes "(R2*R3)/(R2+R3)." When a signal turning off the first switching element S1 is inputted to the trigger input terminal TRG, the third resistor R3 is disconnected from the ground terminal and the total resistance RA of the second and third resistors R2 and R3 becomes "R2."

Since the total resistance RA of the on state of the first switching element S1 is smaller than the total resistance RA of the off state of the first switching element S1, the reference voltage VREF of the reference voltage compensating part 150 of the on state of the first switching element S1 may be higher the reference voltage VREF of the reference voltage compensating part 150 of the off state of the first switching element S1.

As a result, the reference voltage VREF of the reference voltage compensating part 150 may be controlled to increase by inputting the signal turning on the first switching element S1 to the trigger input terminal TRG. Alternatively, the reference voltage VREF of the reference voltage compensating part 150 may be controlled not to increase by inputting the signal turning off the first switching element S1 to the trigger input terminal TRG.

In the OLED display device 100, according to the active section AT and the blank section BT, the reference voltage VREF may increase or may not increase by controlling the signal inputted to the trigger input terminal TRG.

Figure 6:
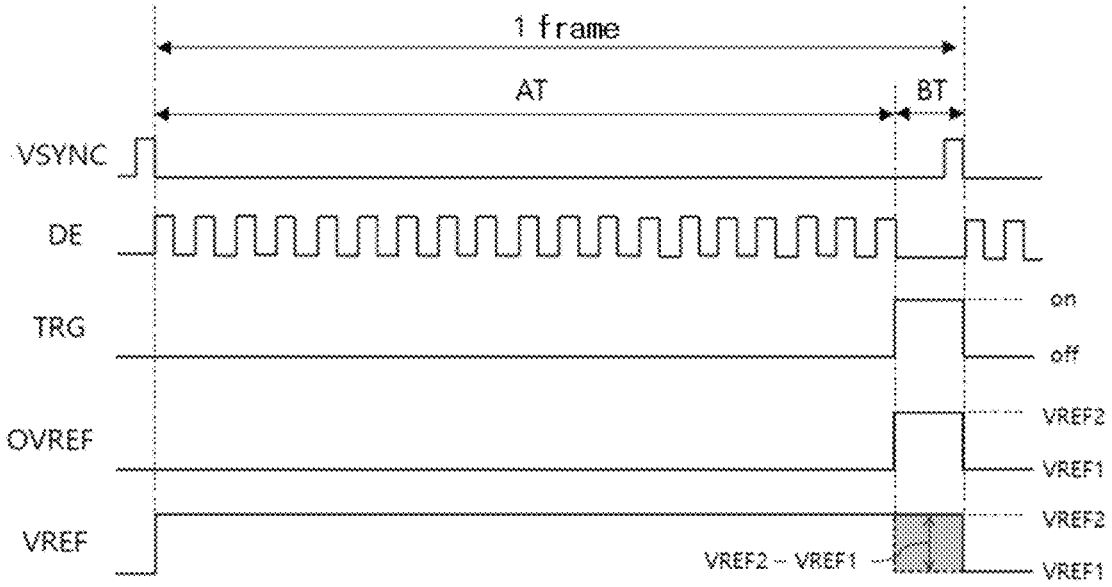
FIG. 6 is a timing diagram showing driving signals for compensating a reference voltage of an organic light emitting diode display device according to an embodiment of the present disclosure.

FIG. 6 is a timing chart showing driving signals for compensating a reference voltage of an organic light emitting diode display device according to an embodiment of the present disclosure.

In FIG. 6, driving signals includes the horizontal synchronization signal VSYNC, the data enable signal DE, a trigger signal TRG applied to the trigger input terminal TRG (of FIG. 5), an output voltage OVREF outputted from the output terminal OVREF (of FIG. 5) of the reference voltage compensating part 150 (of FIG. 5) and the reference voltage VREF applied to the pixel region P (of FIG. 1).

During the active section AT, the trigger signal TRF turning off the first switching element S1 (of FIG. 5) is inputted to the reference voltage compensating part 150 (of FIG. 5). Here, the reference voltage compensating part 150 outputs the first reference voltage VREF1. Since the initialization period PI is performed for applying the data signal VDATA during the active section AT, the reference voltage VREF applied to the pixel region P may increase from the first reference voltage VREF1 to the second reference voltage VREF2.

During the blank section BT, the trigger signal TRF turning on the first switching element S1 is inputted to the reference voltage compensating part 150. Here, the reference voltage compensating part 150 outputs the second reference voltage VREF2 higher than the first reference voltage VREF1. As a result, the reference voltage VREF reduced during the blank section BT may be compensated by a voltage difference (VREF2−VREF1) of the first and second reference voltages VREF1 and VREF2. When the blank section BT and a section where the emission signal EM2 of a low level voltage overlap each other, the reference voltage compensating part 150 may output the second reference voltage VREF2.

Even when the emission signal of a low level voltage according to the duty driving method is supplied to one horizontal line of the display panel 110, the second reference voltage VREF2 higher than the first reference voltage VREF1 is applied to the pixel region P in the corresponding horizontal line. As a result, the driving current I is reduced and the luminance difference between the horizontal lines is reduced.

Figure 7:
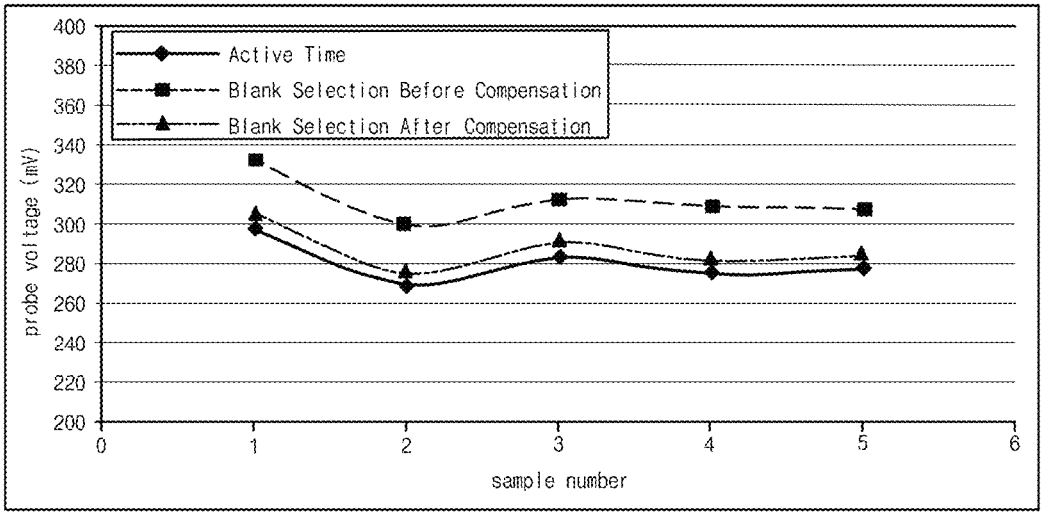
FIG. 7 is a graph showing luminance before and after compensation of an organic light emitting diode display device according to an embodiment of the present disclosure.

FIG. 7 is a graph showing luminances before and after compensation of an organic light emitting diode display device according to an embodiment of the present disclosure.

In FIG. 7, luminances of first to fifth samples of the OLED display device are measured by using a photo probe. An x-axis represents a sample number, and a y-axis represents a probe voltage corresponding to a luminance of the pixel region P. The probe voltages of the active section AT, the blank section BT before compensation and the blank section BT after compensation are shown.

When the reference voltage VREF is not compensated during the blank section BT, the average probe voltage difference corresponding to the average luminance difference between the active section AT and the blank section BT is about 32 mV.

When the reference voltage VREF is compensated during the blank section BT, the average probe voltage difference corresponding to the average luminance difference between the active section AT and the blank section BT is about 6.5 mV.

After the reference voltage is compensated, the average probe voltage difference is reduced by about 25.5 mV which corresponds to about 79.7% of the average luminance difference.

In the OLED display device 100, since the reference voltage VREF is compensated by the reference voltage compensating part 150 from the first reference voltage VREF1 to the second reference voltage VREF2 higher than the first reference voltage VREF1 during the blank section BT, the reference voltage VREF applied to the pixel region P is uniformly maintained.

Accordingly, the reference voltage difference between the blank section and the active section is reduced and the luminance difference between the blank section and the active section is reduced such that the display quality is improved.

It will be apparent to those skilled in the art that various modifications and variation can be made in the present disclosure without departing from the spirit or scope of the disclosure. Thus, it is intended that the present disclosure cover the modifications and variations of the present disclosure provided they come within the scope of the appended claims and their equivalents.

What is claimed is:

1. An organic light emitting diode display device, comprising:

a display panel including a plurality of pixel regions; and a reference voltage compensating part, wherein the reference voltage compensating part:

supplies a first reference voltage to the plurality of pixel regions during an active section where a data enable signal is activated, and supplies a second reference voltage higher than the first reference voltage to the plurality of pixel regions during a blank section where the data enable signal is deactivated, and wherein when the blank section and a section where an emission signal of a low level voltage is supplied to the plurality of pixel regions overlap each other, the reference voltage compensating part outputs the second reference voltage.

2. The device of claim 1, further comprising a gate driving part and a data driving part, wherein the gate driving part includes a shift register having a plurality of stages subordinately connected to each other.

3. The device of claim 2, wherein during an initialization period, the plurality of stages supply a first scan signal of a high level voltage, a second scan signal of a low level voltage and the emission signal of a low level voltage to the plurality of pixel regions.

4. The device of claim 3, wherein during a sampling period, the plurality of stages supply the first scan signal of a low level voltage, the second scan signal of a low level voltage and the emission signal of a high level voltage to the plurality of pixel regions, and the data driving part supplies a data signal to the plurality of pixel regions.

5. The device of claim 4, wherein during an emission period, the plurality of stages supply the first scan signal of a high level voltage, the second scan signal of a low level voltage and the emission signal of a low level voltage to the plurality of pixel regions.

6. The device of claim 5, wherein during the emission period, the plurality of stages alternately and repeatedly supply the emission signal of a low level voltage and the emission signal of a high level voltage to the plurality of pixel regions in K times.

7. The device of claim 6, wherein the K times includes two times to four times.

8. The device of claim 1, wherein during the active section, the reference voltage compensating part outputs the first reference voltage and the second reference voltage is applied to the plurality of pixel regions, and wherein during the blank section, the reference voltage compensating part outputs the second reference voltage and the second reference voltage is applied to the plurality of pixel regions.

9. A method of driving an organic light emitting diode display device including a display panel including a plurality of pixel regions and a reference voltage compensating part, comprising:

supplying a first reference voltage from the reference voltage compensating part to the plurality of pixel regions during an active section where a data enable signal is activated, and supplying a second reference voltage higher than the first reference voltage from the reference voltage compensating part to the plurality of pixel regions during a blank section where the data enable signal is deactivated, wherein when the blank section and a section where an emission signal of a low level voltage is supplied to the plurality of pixel regions overlap each other, the reference voltage compensating part outputs the second reference voltage.

* * * * *